US005787649A

United States Patent [19]

Popowych et al.

[11] Patent Number: 5,787,649

[45] Date of Patent: Aug. 4, 1998

[54] TREE STYLED MONOPOLE TOWER

[75] Inventors: Nestor T. Popowych, 231 Belle Plaine, Park Ridge, Ill. 60068; Roy J. Moore, Arlington, Tex.; Harold H. Sriver, III, 2713 Hartzell St., Evanston, Ill. 60201; Louis Ken-Hon Kao, Hanover Park, Ill.

[73] Assignees: Nestor T. Popowych, Park Ridge, Ill.; Harold H. Sriver, III, Evanston, Ill.; FWT, Inc., Fort Worth, Tex.

[21] Appl. No.: 381,504

[22] Filed: Jan. 31, 1995

Related U.S. Application Data

[63] Continuation-in-part of Ser. No. 202,444, Feb. 28, 1994.

[51] Int. Cl.[6] ..... E04H 12/00

[52] U.S. Cl. ..... 52/40; 52/651.02; 52/651.07; 52/726.4; 52/721.4; 52/736.3; 52/738.1

[58] Field of Search ..... 52/40, 727, 726.4, 52/721.4, 736.1, 736.2, 736.3, 738.1, 651.01, 651.02, 651.07; 428/7, 10, 8, 20, 9, 18, 19

[56] References Cited

U.S. PATENT DOCUMENTS

| | | | |
|---|---|---|---|
| 2,251,705 | 8/1941 | Gonzalez | 428/8 |
| 3,571,991 | 3/1971 | Doocy | 52/651.02 X |
| 3,829,349 | 8/1974 | Hermanson | 428/8 |
| 4,343,842 | 8/1982 | Chase | 428/8 |
| 5,150,874 | 9/1992 | Spiegel et al. | 428/8 X |

OTHER PUBLICATIONS

Sautter, William H., "Clones, Poles Apart", The New York Times Magazine, Sunday edition, Aug. 27, 1995, p. 22.

*Primary Examiner*—Carl D. Friedman
*Assistant Examiner*—Beth Aubrey
*Attorney, Agent, or Firm*—James E. Bradley

[57] ABSTRACT

A modified monopole tower is described, consisting primarily of a galvanized steel truncated pyramidal monopole capped by wireless electronic communications antennae and equipment. In the preferred embodiment, the simulated trunk containing the monopole exhibits protruding receptors which in turn support artificial palm fronds, and artificial pine boughs and branches. The artificial palm fronds, branches, and boughs are attached to the receptors primarily by mechanical and adhesive means. The modified monopole tower is designed to function optimally under all weather conditions, while imitating the landscape with attachment of indigenous tree components.

17 Claims, 11 Drawing Sheets

TREE STYLED MONOPOLE TOWER

BACKGROUND THE INVENTION

This is a continuation in part of the application, Ser. No. 08/202,444, filed Feb. 28, 1994, by inventors Nestor Popowych, Harold Sriver III, Roy J. Moore, and Louis Ken-Hon Kao. This application contains new matter and amendments, and new claims to what was originally a monopole disguised as an artificial palm tree. This patent application describes two mechanically similar structures, camouflaged as an artificial palm or pine tree respectively.

The present invention relates to a metal wireless electronic communications antennae and equipment support structure, with artificial tree components which function as a camouflage. More particularly, the present invention relates to a tower which contains wireless communications transmitting and receiving equipment, and artificial palm fronds, pine needle clusters, boughs and branches attached to a vertical metal pole to comprise a tower in the guise of a tree.

There has been a long-standing need in the telecommunications industry for an aesthetically-pleasing motif, such as a shrub or tree, that would disguise the otherwise stark pole-type structures currently available. Moreover, the tower must be functional and support all the antennae elements of a wireless communication system. The camouflage elements must also be strong and resilient, not disintegrate into a safety hazard when subjected to strong winds.

In the past others have suggested numerous assemblies and structures for constructing artificial plants for purely decorative purposes or functionally to cover utility poles and the like. For example, one choice might be to simply construct a completely rigid structure with a widened crown which would contain artificial foliage along the length of a pole-like structure. However, others have recognized the potential weather problems with this choice. For example, U.S. Pat. No. 5,359,737 (Bond) discloses an artificial tree for absorbing and scattering radiation. Attenuating means on the leaves are electrically conductive particles forming dipoles to accomplish coherent absorption and scattering of radiation. However, this device is not constructed to withstand high winds and temperature extremes as is contemplated in the present invention.

U.S Pat. No. 5,085,900 (Hamlett) discloses an artificial palm tree structure comprising a trunk, a cylindrically shaped cap, a plurality of fronds,and a support. This artificial palm tree has a cylindrical pole which simulates a trunk when covered with artificial palm tree bark. The structure is made of sections with couplings for connecting the sections during installation. Although disguised like the present invention because it reassembles a palm tree, the structure of Hamlett's invention is not an integral part of a galvanized steel tapering pyramidal monopole with attachments for artificial fronds at the top of the monopole.

In contrast, in the present invention the wireless receiving and transmitting devices are an integral component. In other words, Hamlett's end product is the tree, whereas in the present invention the housing of the wireless receiving and transmitting devices is the end product which is camouflaged with the indigenous trees.

U.S. Pat. No. 4,855,167 (Biehl) discloses artificial trees which are intended to shade an outdoor parking area. These artificial trees contain branches attached to three axially spaced distinct tiers of apertures located on the top end of the trunk for providing shade. U.S. Pat. No. 3,928,712 (Sears) discloses a terminal enclosure with artificial foliage. This structure is comprised of a post terminal covered by an upright cone-like housing secured externally, to add supporting simulated foliage. This structure is designed specifically to camouflage and protect ground terminals for utility companies.

U.S. Pat. No. 3,144,375 (Day) discloses an artificial tree which may be used for outdoor and indoor aesthetic purposes. Instead of synthetic resins for leaves, green lacquers are applied. The artificial trunk has male and female joints so that a tree ranging from small to large may be assembled. U.S. Pat. No. 3,562,404 (Monahan et al.) discloses resin coated wooden poles and light standards, for stress relief and ventilation purposes. U.S. Pat. No. 5,130,496 (Jenkins) discloses an aesthetic electrical cord cover which consists of an elongated tubular body having simulated leaves protruding outwardly from the outer surface of the body.

U.S. Pat. No. 5,104,467 (Johnson) discloses a method for constructing artificial plants having a natural appearance. However, this method only provides for modifying artificial foliage for a more airy, naturally appearing leaf pattern, and which is ultimately combined with naturally occurring plants. Clearly then, the function of this invention is to provide beautification of surrounding areas, and not to shelter wireless electronic communications equipment.

U.S. Pat. No. 5,091,227 (Wright et al.) discloses a decorative tree which is easily assembled and particularly adapted to blend with the furniture of the room in which it is placed. Again, this invention is not designed to house wireless electronic communications equipment and antennae in an exterior environment. U.S. Pat. No. 3,857,747 (Boteca) describes an artificial shrub with a high density polyethylene shell to which foliage sprays are stapled in a multitiered fashion. The primary purpose of this artificial shrub is to protect the open mouth of a port which has been placed on the ground. U.S. Pat. No. 3,887,415 (Elmendorf et al.) describes a panel with a decorative bark surface, and describes the method of making the bark. U.S. Pat. No. 2,303,5699 (Menard) describes a similar artificial bark and method for its construction.

U.S. Pat. No. 2,251,705 (Gonzales) describes an artificial palm tree "for interior decoration and human comfort." Specifically, the artificial palm is constructed so that the interior can contain a limited air conditioning system. U.S. Pat. No. 2,218,740 (Burke) describes another process of producing imitation tree bark, as does U.S. Pat. No. 2,166,002 (Fritsch).

U.S. Pat. No. 4,769,967 (Bourrieres) describes a pole of plastic material or supporting electric power transmission lines, and U.S. Pat. No. 4,007,075 (McClain et al.) describes a method for making a fiberglass pole. U.S. Pat. No. 3,317,365 (Reichert et al.) describes a nonflammable synthetic decorative tree branch.

U.S. Pat. No. 3,170,587 (Beeber) describes devices for concealing and supporting refuse receptacles on the exterior of a residence which, however, simulate shrubbery and other plants which would naturally be found on a lawn or in a back yard. Anderson's artificial tree, U.S. Pat. No. 1,656,310, comprises a base with a trunk extending upwardly from the base, and the trunk being formed so that it can receive a plurality of natural tree branches.

Slane, U.S. Pat. No. 5,106,042, describes a display pole assembly for merchandising displays. The decorating object may be a tree which is mounted on top of a pole section, and the pole may be covered with bark to simulate a tree trunk. Cajigas, U.S. Pat. Des. 309,208 discloses a trash container with a leaf-lid container top.

Tailor's design patent (Des. 244,570) discloses a combined merchandise display counter and ceiling air circulator, which is designed to have some attributes of a palm tree.

Many artificial pine trees have been designed to simulate natural pine Christmas trees with mechanical structure not designed for withstanding outdoor elements, for example U.S. Pat. No. 4,399,172 (DeCosmo). U.S. Pat. No. 3,374,798 (Samuelson et. al.) discloses a camouflage device with pivotally arranged ribs and artificial vegetation to cover large objects such as cannons, tanks, and motor vehicles. U.S. Pat. No. 3,170,587 (Beeber) discloses devices for concealing and supporting refuse receptacles with artificial foliage, but with a body member and a cover member cooperating to simulate the shape of a shrub.

Bogart's artificial tree construction, U.S. Pat. No. 3,865,676, demonstrates a post simulating a tree trunk. This device has upper and lower supports with removable green panels extending between the upper and lower supports. This device is another attempt to create a light weight easily assembled Christmas tree with greenery supported by the top and bottom components of the pole structure. Bogart's artificial plant, U.S. Pat. No. 3,647,605 consists primarily of a latticework to loosely simulate the shape of a tapering shrub. The latticework, in turn, is covered with branches bent into general U-shapes. The goal here was a novel supporting structure and method of assembly, particularly for the easy assembly of Christmas trees.

Yet another artificial tree by DeCosmo, U.S. Pat. No. 3,634,180, demonstrates a tree wherein the branches are anchored between four parallel wires arranged in quadrature. The tree is assembled by piling the branches between two V-shapes wires set in orthogonal planes, then bringing the ends of the wires together locking the branches in place.

None of the foregoing structures have environmentally resilient, galvanized steel monopoles supporting a large weight of wireless electronic communication equipment and antennae. They also do not have artificial foliage components which camouflage without interfering with emanating radio signals. The present palm tree invention is more aesthetically pleasing in that it will retain its plant-like characteristics outdoors for many years. The present artificial pine tree invention is also aesthetically pleasing in that it will retain its plant-like characteristics outdoors for many years in extremely hot, or wet and cold climates.

This invention of aesthetically I ecologically pleasing, yet sturdy and functional camouflage is uniquely designed to address the problems associated with providing wireless system coverage in aesthetically sensitive areas. It also provides for wireless electronics communications antennae to be placed where existing tall structures are unavailable, or traditional antennae tower structures are undesirable. The antennae structure itself is designed to be highly resistant to the effects of weather and wind, as is the requirement for traditional antenna towers.

SUMMARY OF THE INVENTION

To solve this problem in the industry, the present invention provides a wireless communications antennae tower of monopole construction which houses and supports wireless communications antennae and camouflages them as palm or pine trees. In addition, because it is intended for outdoor use, the palm and pine tree inventions are engineered so that the artificial fronds, pine boughs, branches, and simulated pine needle clusters will not break and fall from the tower.

Accordingly, an object of the present invention is to provide a wireless electronic communications antenna tower which provides an appropriate functional height for the intended service.

Another object of the present invention is to provide artificial palm or pine tree components that camouflage the wireless communications antennae and equipment.

Another object of the present invention is to provide a strong, yet lightweight artificial greenery which blends in with the indigenous foliage to disguise a wireless electronic communications antennae tower.

Another object of the present invention is to provide artificial tree components which can withstand adverse weather conditions while attached to the monopole and yet maintain an aesthetic appearance for many years.

Another object of the present invention is to provide artificial branches, boughs, fronds, and pine needle clusters, so that an antennae can be placed securely among the branches, yet not have the wireless electronic communications antennae patterns distorted and disrupted thereby.

Yet another object of the invention is to provide the artificial tree components which will camouflage the electronic and wireless electronic communication components without interfering with the transmission or reception of specific radio signals.

Yet another object of the invention is to provide a plurality of artificial tree monopoles with a connecting platform to form a multi-monopole wireless communication system.

These and still other objectives and advantages of the present invention will become apparent from the following description of the preferred embodiment.

BRIEF DESCRIPTION OF THE DRAWINGS

The present invention may be better understood by reference to the drawings accompanying this specification.

DETAILED DESCRIPTION OF THE INVENTION

Figure 1:
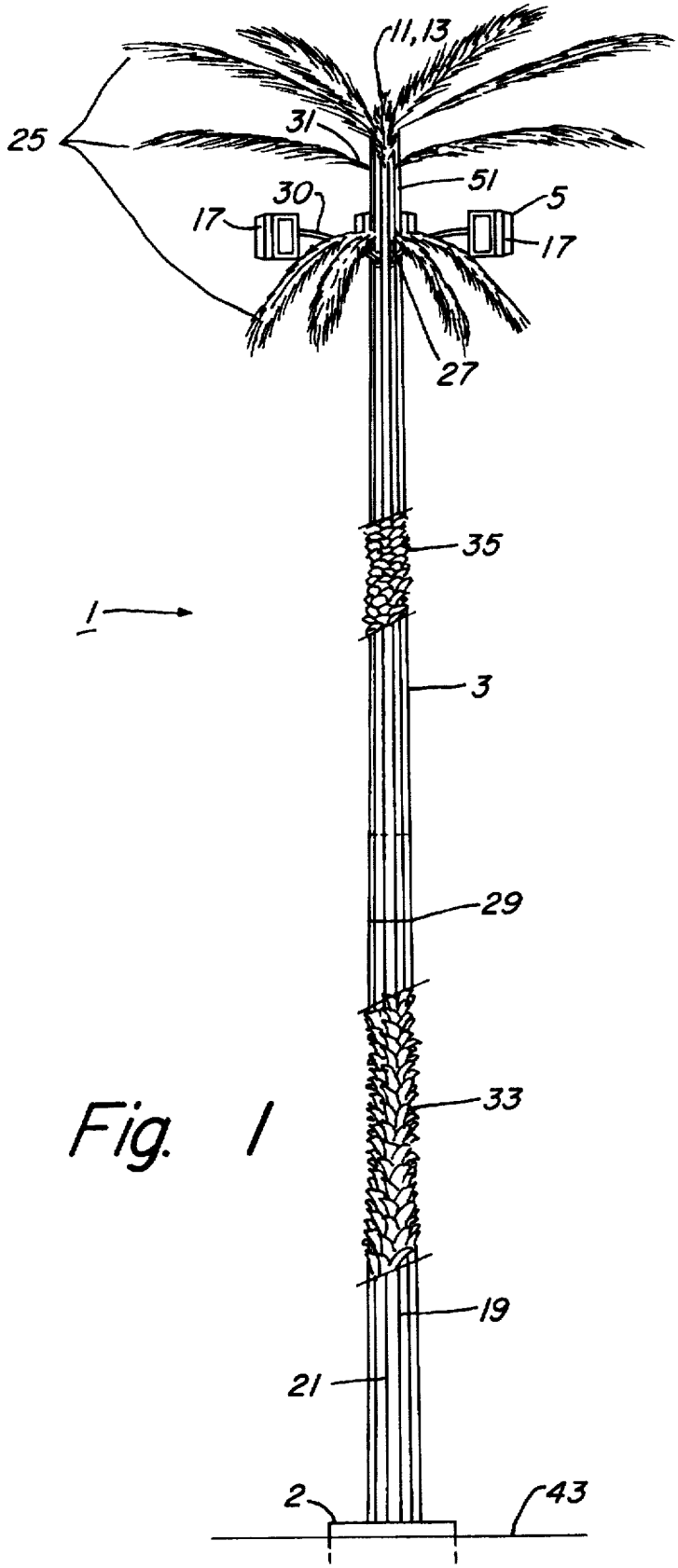
FIG. 1 is an illustration of the entire monopole tower with protruding artificial palm fronds and antenna.

In this continuation-in-part application, the original embodiment of the present invention, is best described as a monopole wireless electronic communications antennae and equipment tower with natural appearing, but simulated tree components 1. The original embodiment of the present invention is best described as a monopole wireless electronic communications antennae tower 3 with natural-appearing, but simulated palm tree components. The preferred embodiment comprises a wireless electronic communications antennae and equipment structure 5, the monopole 3, and artificial palm tree components. Specifically, the invention is comprised of a metal monopole 3 which tapers upward and terminates to a tip 11 or a cap plate 13, to support the wireless electronic communications equipment and antennae panels 17 of the structure.

The monopole itself 3, without artificial appurtenances or components, typically has 8,10,12, or 16 sides as seen at 19,21 on monopole 3. The number of sides or facets will depend upon the tower's height, the wind load for a particular configuration of the wireless antennae, and the accompanying artificial palm frond camouflage. At the upper end of the monopole 3 there are artificial palm fronds 25 attached by mechanical means to outwardly protruding metal female receptors 27, which will be described in detail below.

In the preferred embodiment, the monopole 3 is the type provided by FWT, Inc. of Fort Worth, Texas. However, similar monopoles obtainable from other sources are also included within the scope of this invention.

Also in the preferred embodiment, the antennae support assembly is comprised of a galvanized steel monopole 3 which tapers upwardly from its base to a top or cap plate at the very top of the monopole. As already mentioned, this steel monopole 3 can be many-sided or faceted, depending upon the required height and an engineer's calculations for wind related stress forces. The preferred steel for construction of the shaft monopole 3 is ASTM A-575 Grade 65, 50, or 36, and the galvanizing process is ASTM A-123. The antennae cable entries are at the base 2, as is the tower foundation. There is also a butt connection 29 for the different types of simulated palm bark components along the length of monopole 3. In the preferred embodiment, at the upper end of the monopole 3 are six to nine directional panel antennae 17 cantilevered on arms 30 of steel tubing. However the invention also contemplates that the steel arms for antennae 30 can emerge from between any coronae of palm fronds 25.

In the preferred embodiment the artificial palm plant components simulate a palm tree. Also in the preferred embodiment, the artificial palm fronds 25 are approximately eight feet long and thirty-six (36) inches wide at the base, while tapering to ten inches wide at the tip of the frond.

However, the invention also contemplates a range in frond length of between approximately four feet to approximately ten feet. The stem of the frond is approximately 1 and ½ inch in diameter at its base and tapers to approximately ⅜ inch at its tip. The leaflets which comprise the fronds are molded of polyurethane with a greenish yellow and greenish brown coloring. Each artificial palm stem 31 of a frond is embedded with a rigid spine, comprised of a threaded nylon rod or similar material, steel, or high-strength urethane or other resin. This spine or rod extends from the base of the frond through approximately seven inches of the stem portion of the frond. Injection of adequate polyurethane at the junctions between each leaflet and the stem of the frond insures stability during strong wind forces. Each frond ranges from approximately 3025 grams (6 lbs.11 oz.) to 3652 grams (8 lbs. and 1 oz) in weight. For the preferred embodiment, the source of the palm fronds and attached leaflet material is Preserved Treescapes, Carlsbad, California. However, similar materials which are obtainable from other sources are also included within the scope of this invention.

FIG. 1 illustrates a side view of the entire wireless electronic communication antennae and equipment support structure of monopole 3. In the preferred embodiment, the plurality of sides, or facets on the galvanized steel monopole 3 can be seen at 19,21. This multifaceted galvanized steel monopole 3 rises upwardly as a tapering truncated pyramid form to either simply terminate at its tip at the top of the monopole or terminate in a cap plate 13. The degree of taper for the monopole 3 is 0.25 to 0.5 inch per lineal foot.

Also in the preferred embodiment, the steel monopole 3 is clad with two types of simulated bark. Material intended for the lower portion of the monopole is fiberglass 33, cast as half-tubes within a mold to simulate natural palm bark, and which is fairly rigid. The matrix for the fiberglass material may be acrylic, silicone, or epoxy. The upper portion, generally fifteen feet above the base of the monopole 3, is covered with a polyurethane, and is also cast to simulate natural tree bark 35.

The polyurethane allows the upper covering more flexibility when the monopole 3 sways as a result of wind forces. The two kinds of bark castings 33,35 are first cut to naturally fit around the bottom or upper portion of the monopole 3. The two kinds of bark, upper and lower, then meet at butt junction 39, approximately 15 feet from the base of the monopole 3. However, the use of only one kind of artificial or simulated palm tree bark to cover the entire monopole 3 is also contemplated within the scope of this invention.

In the preferred embodiment the monopole tip or cap plate is elevated approximately 20 to 70 feet from the ground 43. However, the monopole can be as high as 125 feet and is made of shaft steel ASTM A-572 grades 65, 50, or 36. In addition, in the preferred embodiment, immediately below the monopole tip or cap plate are the directional panels 17, in antennae assembly 5. However, as already noted, the supports for the antennae can emerge between any level of corona with fronds 25. The galvanized steel monopole 3 is approximately thirty inches in diameter at its base 2, and tapers to 16 inches in diameter towards its upper portion 51. The baseplate member is of material ASTM A-572 Grade 50 steel. During wind tunnel tests conducted on the artificial palm fronds, such palm fronds adhered to their attachments at wind speeds up to 110 mph for at least 10 to 12 minutes.

Figure 2:
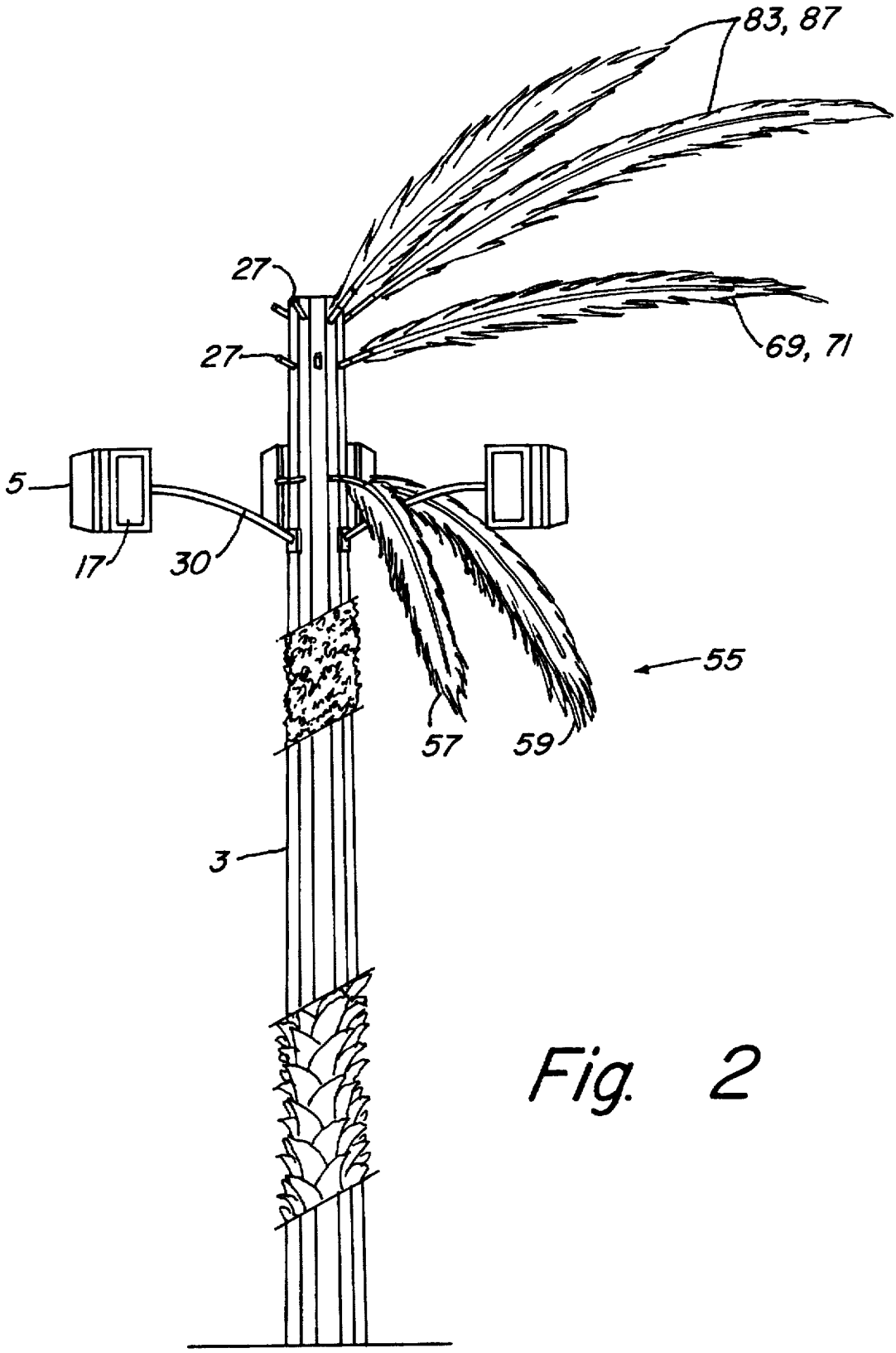
FIG. 2 is a view of protruding metal female receptors with artificial palm fronds in a coronae.
Figure 3:
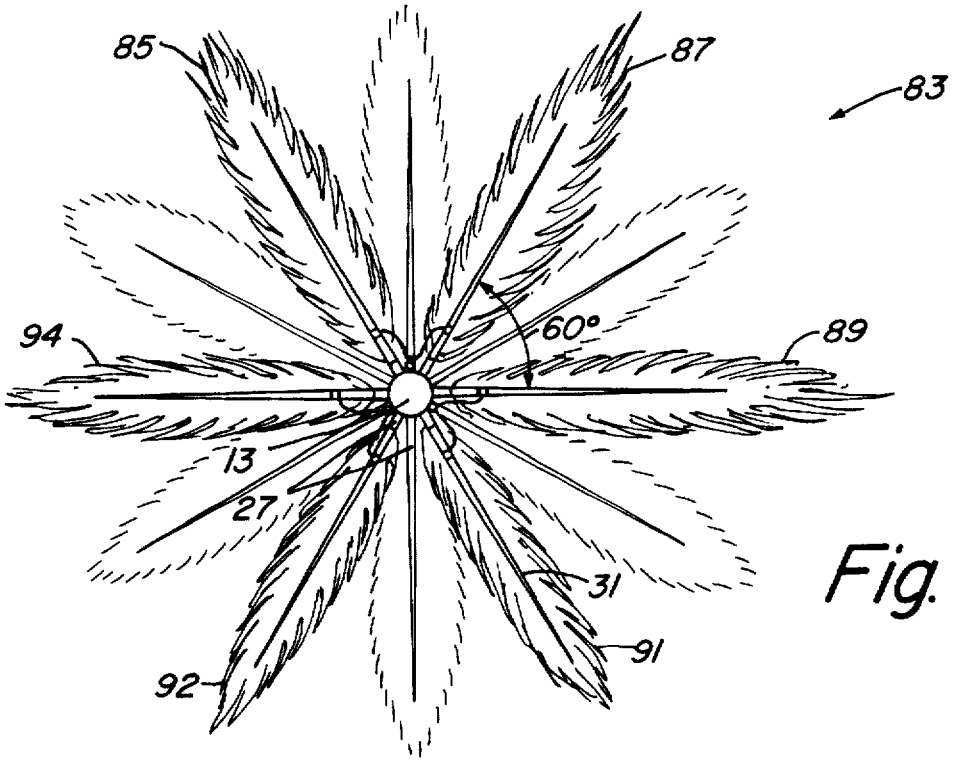
FIG. 3 is a plan view of the highest corona of the welded female receptors artificial palm fronds.
Figure 4:
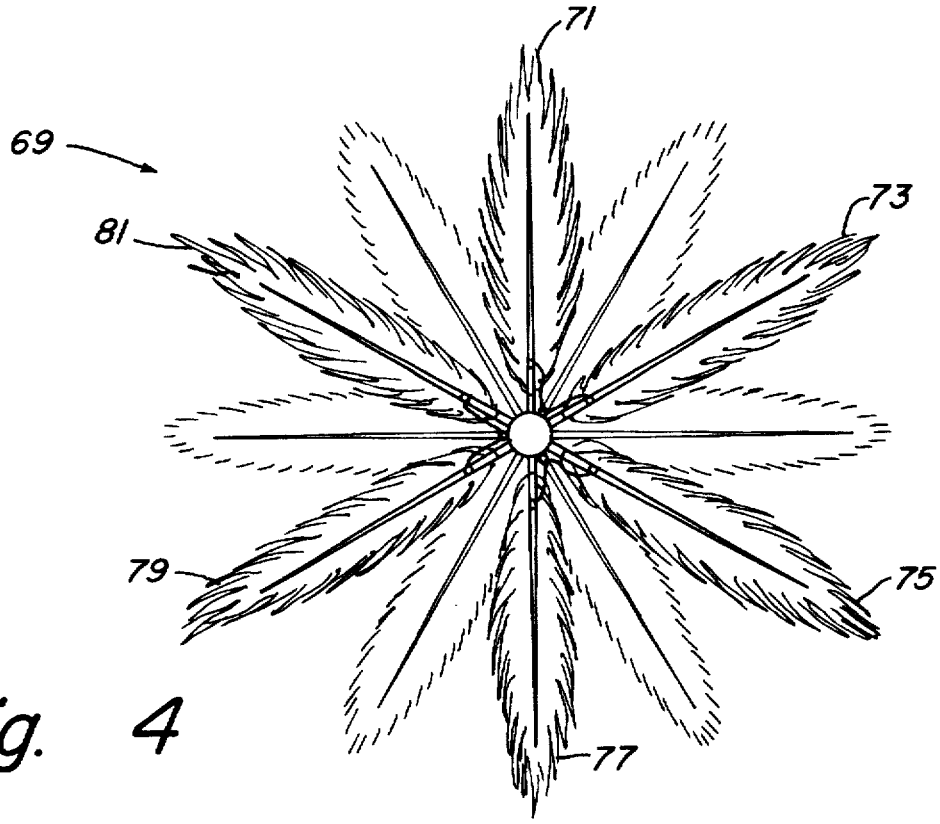
FIG. 4 is a plan view of the second highest corona of female receptors with artificial palm fronds.
Figure 5:
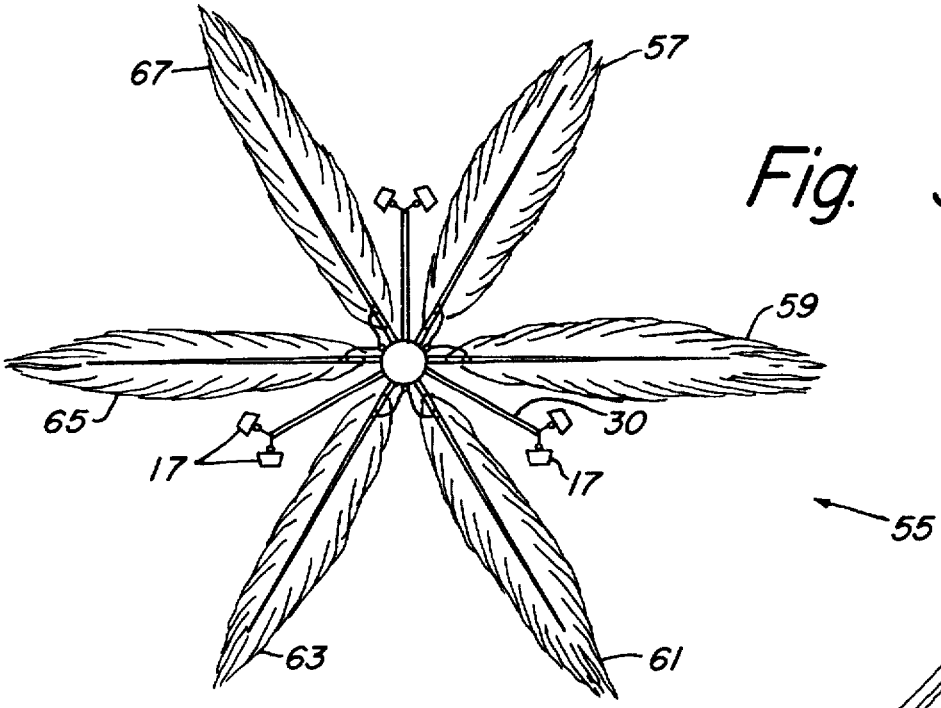
FIG. 5 illustrates a plan view of the lowest corona with artificial palm fronds.

FIG. 2 illustrates a side view of the structures which comprise the three parallel coronae with artificial palm fronds. In this context the term corona signifies a ring around the upper part of the monopole. In the preferred embodiment, these coronae each contain six artificial palm fronds which emerge at the top portion of the monopole 3 or the monopole tip 11 or cap plate 13. The lowest corona 55 along the monopole is located at fronds 57, 59, 61, 63, 65, 67, as seen in FIG. 5 although most of the fronds cannot be seen in FIG. 2. The next highest corona 69 is at 71, 73, 75, 77, 92, 94, as seen in FIG. 4, and the highest corona 83 is at 85, 87, 89, 91, 92, 94 as seen in FIG. 3. Again, several fronds in the middle corona and in the highest corona cannot be seen in FIG. 2.

Each of the two highest coronae typically has six female upwardly protruding receptors 27 for a total of twelve receptors 27. However, the bottom corona has six female receptors protruding slightly downward, so that when fronds are attached, they have a natural, drooping appearance. To further enhance their natural appearance the fronds 25 from the lowest corona are shorter than the upper fronds and are different shades of green, yellow and brown. The designed windload for the fronds 25 and other equipment attached to the monopole 3 is up to 110 miles per hour for ten to twelve minutes.

FIG. 3 illustrates a plan view of the highest corona 83, where each female receptor 27 is approximately eight inches in length. Typically, the female receptors are approximately 60 degrees in either direction from each adjacent female receptor. However, the arrangement in the highest corona can be in a range of 110 degrees apart to accommodate antennae and to make the arrangement of fronds 25 appear more natural.

FIG. 4 represents another plan view immediately below the highest corona to corona 69. In this illustration the highest corona is not shown for purposes of simplicity. As with the highest corona, each female receptor 27 is approximately eight inches in length.

FIG. 5 illustrates the corona lowest in height along the monopole 3. Again, each outwardly and slightly downward protruding female receptor 27 is approximately 8 inches in length and one and onehalf inches in width. The angle between adjacent receptors projected on a horizontal plane is approximately 60 degrees in the preferred embodiment, but can range between ten degrees and 120 degrees.

In the preferred embodiment, panel antennae can be seen on the extending steel supports 30 which originate below the lowest corona However, this invention also includes within its scope steel supports for the panel antennae which originate between any corona of artificial fronds 25.

Figure 6:
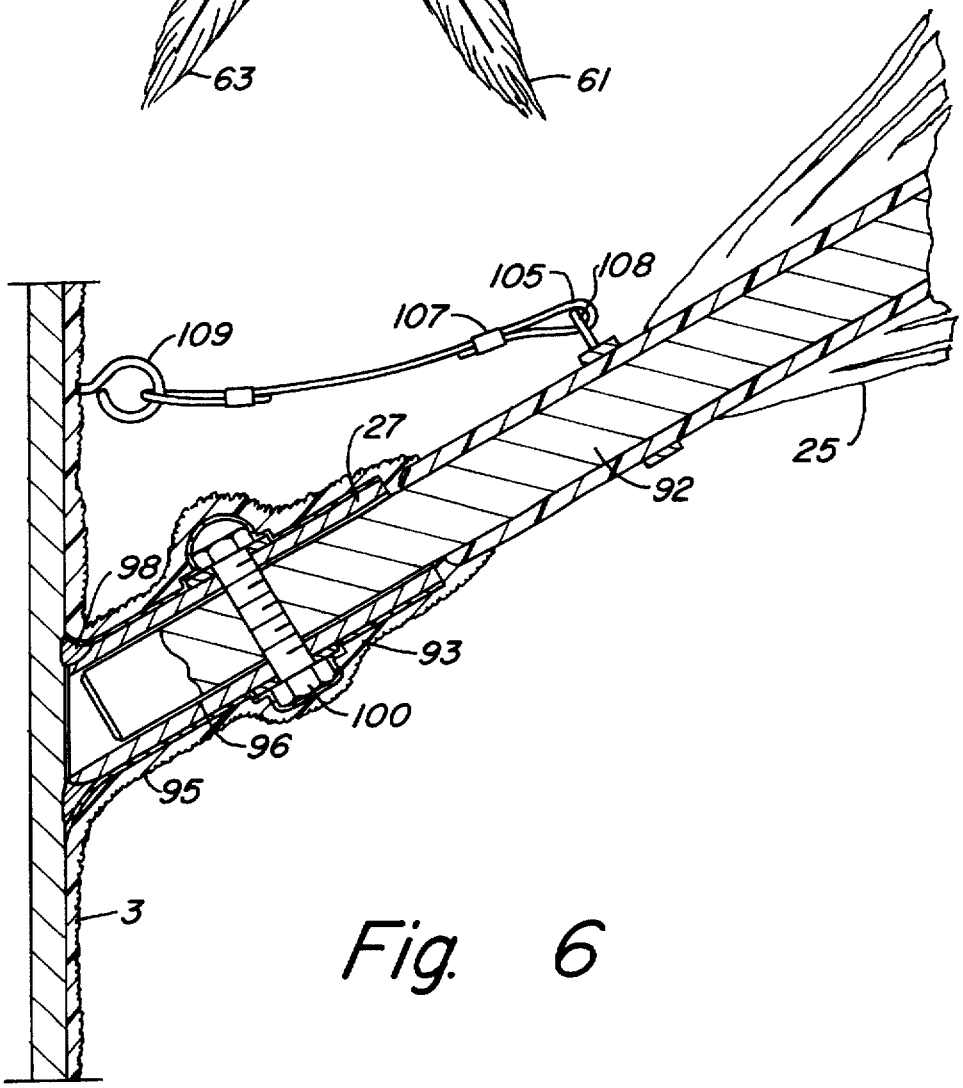
FIG. 6 is a detailed illustration of an assembly of an artificial palm frond securely inserted into a female receptor which is welded to the mole.

FIG. 6 illustrates how one frond 25 appears when attached to one side of the monopole tower 3. In the preferred embodiment, a steel stem 92 of each palm frond 25 originates in a female receptor 27, where each receptor is covered by a gusset-like weld 98. This assembly is then covered by polyurethane 93. If the stem is also glued in some manner as is the bark 95, for the best mode the recommended mastic 96 is manufactured in St. Paul, Minn. by 3M (Industrial Specialties Division). This mastic has as principal ingredients polyol and isocyanide. However, other appropriate adhesives are also contemplated within the scope of the invention.

One such alternative mastic, also manufactured by 3M, is known as construction mastic 4323. This particular mastic has synthetic rubber as a base with a hexane solvent and other additives. It is suitable for plywood, concrete, aluminum, steel, and polystyrene foam. An appropriate adhesive with similar properties to the above, but not limited thereto, is also contemplated for securing all types of artificial bark to the monopole tower 3.

FIG. 6 also illustrates in detail the preferred embodiment for attachment of each artificial palm frond stem to each female receptor 27, which for the two upper coronae have upwardly protruding receptors 27. Each receptor 27 is welded 98 to the side of the monopole tower 3 or to the monopole tip or cap plate. The metal protruding female receptors 27 are approximately eight inches long, and approximately one and one-half inches wide. There is a through bolt 100 which penetrates the female receptor 27 and male end of the palm frond, simultaneously securing one to the other at approximately the receptor's midpoint. A polyurethane layer 93 surrounds each female receptor 27 and bolt and is approximately ¼ inch thick. Superimposed over this layer 93 is the bark material 95 wrapped around the female receptor 27.

In the preferred embodiment the frond 25 can also be further secured against falling by mechanical means such as a cable or rope 105 attached to a clamp 107, which loops through eyelet connector device 108 on the palm frond and attaches to the monopole tower 3 at another location 109 on the same tower. Other mechanical means contemplated within the scope of the invention to further secure the female receptors 27 to the monopole 3 include bolts and nuts. Another securing device is a nylon rope inserted within the stem of the palm frond and attached to the receptor on the monopole. Other connective means, adhesive o r mechanical, are also included within the scope of the invention.

Figure 7:
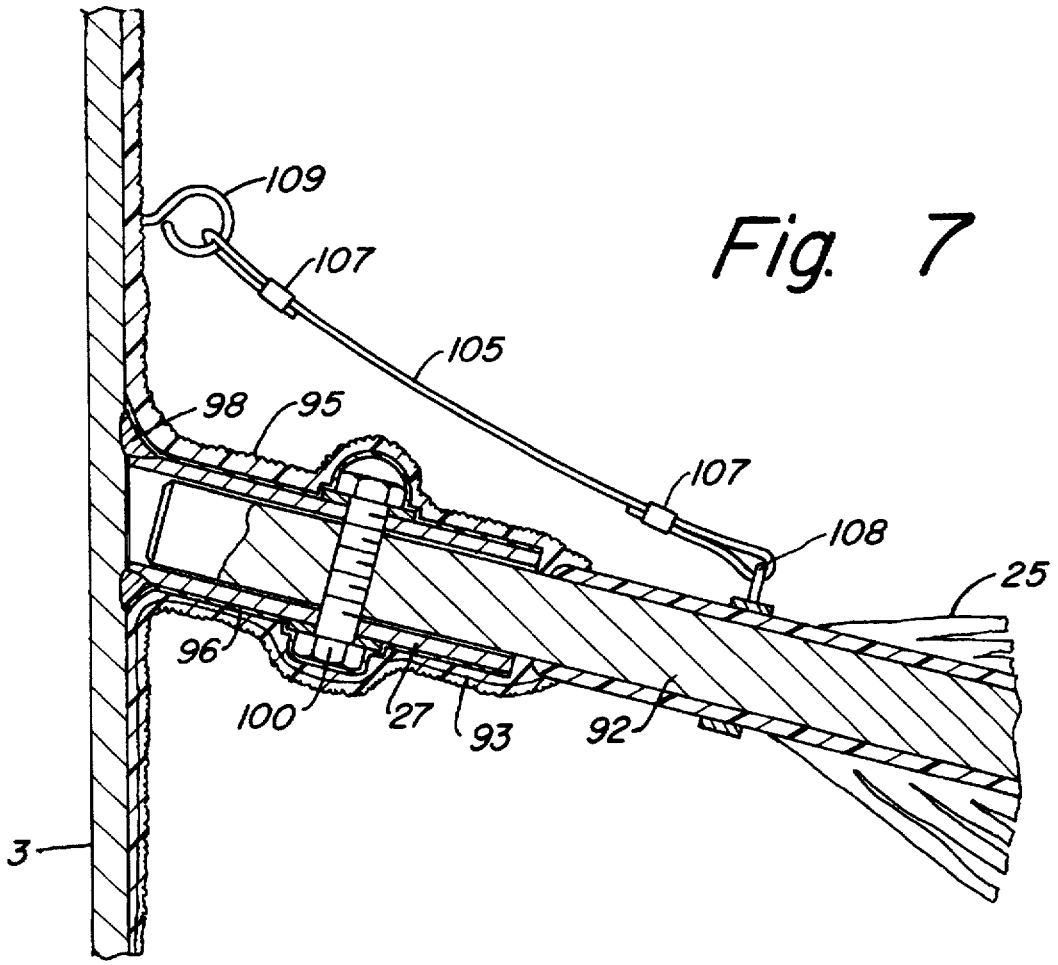
FIG. 7 is a detailed illustration of an assembly similar to that in FIG. 6, but the female receptor is now protruding slightly downward in the lowest corona on the monopole.

FIG. 7 shows the fronds 25 emerging from the lowest corona. Consequently, the receptors 27 are oriented outwardly and slightly downward, instead of protruding upwards. This gives the shorter and lower fronds 25 a m ore natural appearance when they droop downwards and exhibit colors such as a different shade of green, brown, or yellow.

The most current embodiment of the present invention in this continuation-in-part application, is also best described as a monopole wireless electronic communications antennae and equipment support structure 201 with natural appearing, simulated pine tree components. See FIG. 8. The preferred embodiment comprises wireless electronic communications antennae and equipment, a galvanized steel tapering pyramidal monopole 203, antennae and receiver assembly 205, and artificial pine tree components such as branches 209 and boughs 211. Specifically, the invention is comprised of a metal monopole 203 which tapers upward and terminates at a tip 206 or cap plate 208, to support the wireless electronic communications antennae and equipment. The monopole itself 203, has a polygonal shape and typically has 8, 10, 12, or 16 sides as seen at 210, 212. The number of sides or facets will depend upon the tower's height, the wind forces for a particular configuration of wireless electronic communications antennae and equipment, and the accompanying artificial pine branches 209 and boughs 211.

Located primarily at the upper and middle portions of the monopole 203 are the artificial pine branches 209 and boughs 211 attached primarily by mechanical means to outwardly protruding metal female receptors 215. The receptors are located approximately 10 inches from above and below each other at a slight angle, and their structure will be described in detail below. For the preferred embodiment, the monopole 203 is the type provided by FWT,Inc. of Fort Worth, Texas. However, similar monopoles from different sources are also included within the scope of the invention.

In the preferred embodiment of the artificial pine tree, the electronic structure is comprised of a galvanized steel monopole 203 which tapers upwardly from the ground to a tip or cap plate. The shaft steel for construction of monopole 203 is ASTM A-Grade 65,50, or 36, and the galvanizing process is ASTM A-123. The antennae cable entries are at the base 216, as is the tower foundation. The cables traverse upwardly through the interior of the monopole to emerge through openings in the monopole 203 to connect to the antennae panels.

The diameter of the metal circular baseplate 216 is approximately 24 inches. The diameter of the base of the trunk is approximately 16 inches in diameter. In the preferred embodiment, the monopole is a twelve-sided polygon with a taper of 0.2284" per lineal foot.

In the preferred embodiment, at the upper end of monopole 203 is a curved polyurethane top 218 (See FIG. 10)with three protruding female receptors 215 to hold and support three simulated pine branches 209 (not seen in this figure). In the preferred embodiment the wireless electronic antennae and equipment 205 is located at the top of the monopole 203. However, the invention contemplates that the steel arms 204 for the wireless antennae receiver apparatus 205 can emerge from between any level of pine boughs 211.

In the preferred embodiment, the artificial pine boughs 211 range from between one and one half feet and four feet in length. The branches 209, which contain the simulated pine needles in leaflet motifs 219, are also approximately one foot to four feet in length. However, the invention also contemplates a range in branch length of more or less than these particular dimensions. Each bough 211 weighs approximately 846 grams (two pounds) without foliage or a spine inserted within the base. Each branch 209 with leaflets weights approximately 196 grams (seven ounces).

The boughs 211 are molded in half-sections in fiberglass molds. After first lubricating the interior of the mold with a hard wax, the first two layers applied are polyester resin, SP9108, obtainable from Plasticolors, Inc. in Ashtabula, Ohio. This prepolymer material contains calcium carbonate, styrene, and talc. The next layer is a fiberglass matt which is thoroughly wetted and covered with a second resin known as Polylite 33-40, available from Reichold Chemicals Durham, North Carolina. Both resins use the same catalyst which has as components polyether, polyol and aromatic diamine. Polylite contains 46–50% styrene monomer and generally cures at 250 degrees F. as an isophthalic based polyester.

The next layer is a fiberglass cloth, covered with a second, fiberglass matting and saturated with Polylite 33-40. The final layer consists of a length of nylon rope embedded in fiberglass segments to give strength to the bough 211 in the event of breakage in the environment.

The filled molds are cured in an oven at 180 degrees for 1 hour or for 24 hours at room temperature at atmospheric pressure. Each bough half section is removed from the mold, and glued or fastened by other mechanical or adhesive means, to another bough half section to complete an artificial bough 211. Polyester resin is the preferred method of gluing the half-section together in this particular embodiment.

Figure 11:
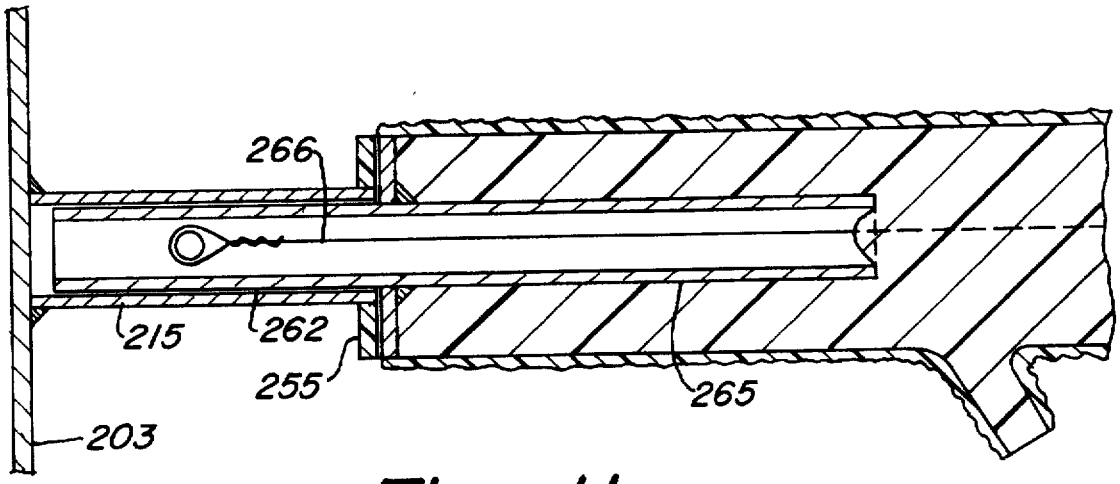
FIG. 11 schematically illustrates a transverse sectional frontal view of a "pine bough" segment as it connects to a female receptor welded to a monopole

Before the cured bough sections are glued together, half of the base of the bough is embedded with a spine 265 as in FIG. 11. The cured sections are then placed with, for example, additional polyurethane or mastic as described above with the palm tree embodiment. The spine can consist of metal, such as steel, a threaded nylon rod, or rigid cured urethane. Each completed artificial base of a bough 211 is thus reinforced with a rigid spine which extends from the bough's base approximately seven or eight inches toward its tips. The spine also protrudes approximately 3 inches externally from the bough base 262 (FIG.11). As a preliminary estimate the largest boughs 211 should withstand approximately 300 to 400 pounds of stress on their tips. The boughs are also designed to withstand 120 mph wind forces parenthesis around with no ice conditions, and with ice in the environment, they are designed to withstand 80–90 mph winds.

A silicon mold is inject with urethane prepolymer to form the pine needle clusters 219 (See FIG. 8), which comprise a component of the branch 209. Branches are usually, but not always, located within a terminus of a bough 211. Each branch has a stem which is approximately 7 to 8 inches long, and this stem has several successive notches and nodules 220 (See FIG. 15), and terminates in a bulb-like member 228. Prior to the gluing together of the two halves of a molded bough, the nodular stem is placed within the two halves at one terminus of the bough half. When the bough segments are glued together, the branch is securely fastened, by frictional, mechanical, and adhesive means to the terminus of that particular bough.

The branches which comprise the pine needle clusters 219 are pigmented with epoxy resin mixed with pigment "blue 15" and pigment "yellow 93." These pigments can be obtained under the trade name Ren, from Ciba-Geigy Corporation in East Lansing, Mich. For the preferred embodiment, a source of the artificial pine boughs and branches with attached pine needle clusters is General Exhibit Displays of Chicago, Ill. However, similar pine needle clusters can be obtained from other sources and still be included within the scope of the invention.

Figure 8:
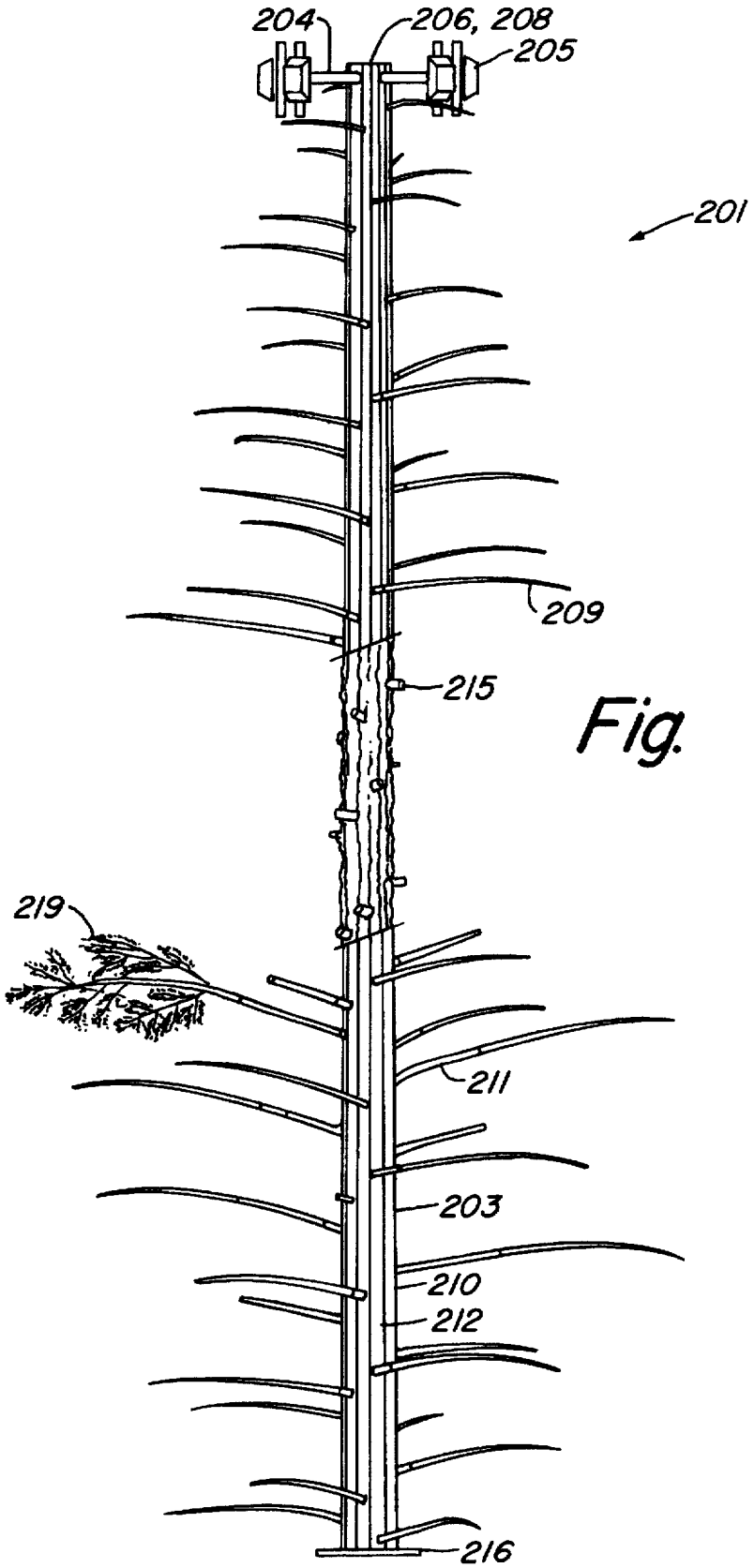
FIG. 8 is a view of a monopole with pine branches, boughs, and antennae assembly.

FIG. 8 illustrates a frontal view of the monopole wireless electronic communications antennae and equipment 201 with artificial pine tree components. In the preferred embodiment the plurality of sides, or facets, on the galvanized steel monopole 203 can be seen at 210,212. This multifaceted galvanized steel monopole 203 rises upwardly as a tapering truncated pyramidal form to either terminate at its tip 206 or in a cap plate 208. The degree of taper for the monopole 3 is approximately 0.2284" per lineal foot. The steel galvanized monopole 203 is approximately thirty inches in diameter at its base 215 and tapers to 16 inches in diameter towards its upper cap portion. The baseplate material is of ASTMA-572 Grade 50 steel.

Figure 9:
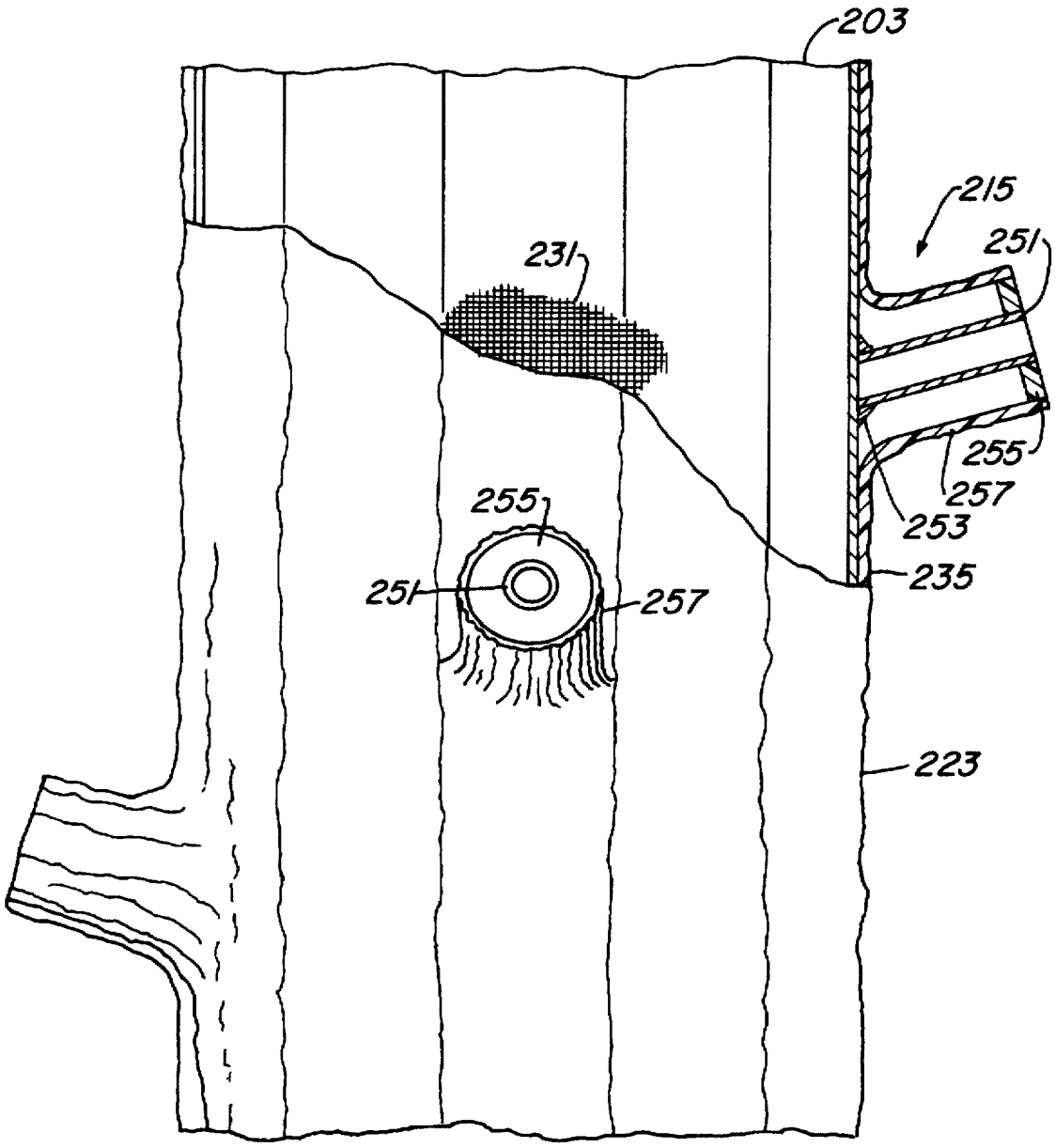
FIG. 9 illustrates a portion of an artificial tree trunk with female receptors for the preferred embodiment of the invention.

FIG. 9 illustrates a segment of monopole 203, with receptors 215. In the preferred embodiment, the steel monopole 203 is clad with simulated bark to form the trunk 223. Here one can see the receptors in transverse and cross-section. The monopole 203 has female receptors 215 protruding through the artificial trunk 223. The cover for approximately the lowest seven to fifteen feet of the monopole is cast or chopped, and sprayed fiberglass 239.

The upper remaining exterior trunk is next covered with blue fiberglass netting 231 which is taped into place over the monopole's exterior surface. Over the glass netting is layered, by brush, spatula, wooden paddle or knife means, urethane prepolymer 235. In this manner the polyurethane also acts as a glue for the fiberglass to adhere to the metal monopole. This is also the same polyurethane material used to mold the pine needle clusters 219, only with a natural dark brown color for the trunk 223.

The female receptors 215, irrespective of their location on the monopole 203, are similarly covered with dark brown polyurethane. This particular urethane polymer system contains methylene bis (4-cyclohexylisocyanate)(HNDI), space and the catalyst comprises ditheyltoluene diamine and mineral spirits. For the preferred embodiment, the prepolymer and catalyst system can be obtained from Conap, Inc., Olean, N.Y. However, other similar polymer and catalyst systems from other sources are also contemplated within the scope of this invention.

Figure 10:
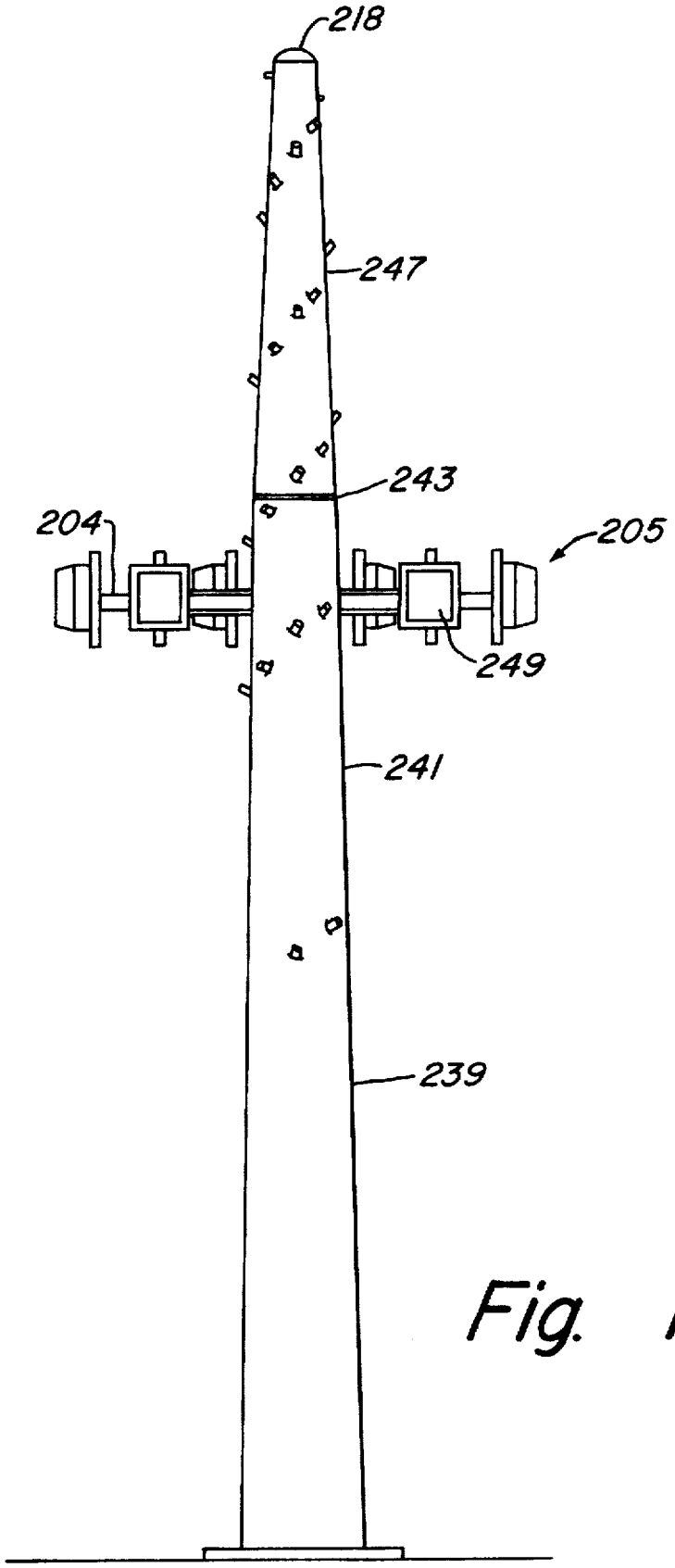
FIG. 10 illustrates another embodiment for the trunk portion of the invention with attached antennae assemblies.

As seen in FIG. 10, in a second embodiment of the trunk 223, a different approach is taken. A fiberglass mold is used to create curved segments, which will comprise the lower portion of the trunk in three segments 239. After lubricating the interior, the mold is filled with first, a layer of urethane prepolymer, and then a layer of fiberglass mat. The urethane prepolymer thoroughly wets the fiberglass mat. Each segment is successively cured and released from the mold. Three segments are then glued together with polyurethane or other adhesive means, and joined with rivets or similar means to form the lower segment 240 of the simulated trunk. All surfaces of the mold are designed to simulate the texture of natural pine tree bark.

In this second embodiment, the middle section of the trunk 241 is covered solely with a polyurethane sheet, to give the monopole structure 203 more flexibility under wind conditions. This middle section is similarly cast within one fiberglass mold, but without the fiberglass component.

A second group of three segments is next made from this same fiberglass mold. As with the first set of molded and cured segments, the material in the mold is cured at room temperature for 24 hours at one atmosphere or placed in an oven for one hour at 180 degrees F. After three finished segments are successively removed from the mold, they are cut to form a cylindrical shape with a smaller diameter to reflect the taper of the monopole 203 at a greater height. The three molded cured segments are glued together with resin/urethane or similar means. They can also be riveted, or reinforced with mechanical means, as were the first three segments forming the bottom portion of the trunk 239.

As also seen in FIG. 10, there may be a butt junction 243 between the second segment of the trunk and the upper section of the trunk section 247. Section 247 is also cast in three segments, but in a narrower, tapering mold. This third upper section can top the pole with additional foliage. It can also be omitted entirely without affecting the radio signals from the antennae and panels located below. If the user wishes to add the additional foliage, then the bark would consist of glass matting and polyurethane, as does the lower trunk segment 240, and the bark layers for the female receptors 215.

In summary, in this second embodiment of trunk construction, the lowest approximately 7 to 15 feet, is polyurethane and fiberglass cast in fiberglass molds. The middle section 241 uses a polyurethane sheet for flexibility. Use of only one kind of artificial tree bark to cover the entire monopole 203 of the pine tree, or the use of only one kind of bark to cover the palm tree monopole 3, is also within the scope of the invention. Moreover, the combination of fiberglass matt and polyurethane covers the female receptors 215 irrespective of on which section of the trunk a receptor is located. However, this would not be the case for the lowest fifteen feet which is solely fiberglass. Any similar resin or appropriate variation of urethane is contemplated within the scope of the invention, assuming it has the requisite properties described in this application, and is suitable for the parameters of this invention.

In the preferred embodiment, the monopole tip or cap plate is elevated from approximately 20 to 125 feet from the ground, depending on the height desired. The monopole can be as high as 125 feet, and is made of shaft steel ASTM A-572 grades 65,50, or 36. In the preferred embodiment, immediately below the monopole tip or cap plate are the directional panels with a total of six to nine antenna panels. However, the scope of the invention is not limited to a monopole height of approximately 20 to 125 feet.

The arms for the antennae and receiver assembly 205 can emerge from any level of female receptors containing boughs 211 or branches 209. However, in the preferred embodiment, the antennae panels 249 to which the cables run after traversing the interior of the monopole, are located at the top of the trunk approximately 20 to 125 feet from the ground. The three antennae panel assemblies 205 are radially dispersed around the trunk equidistant from each other.

As can be seen from FIG. 10 the very upper first 3 ½, " of the tower 218 consists of a curved support which will hold branches which range from approximately ten to twenty inches in length. The stems of a branch are approximately three inches in length.

FIG. 9 illustrates cross-sectional views of the female receptors 215 which support the artificial pine tree boughs 211, or occasionally branches 209. The receptors are actually steel pipe segments 251 which are welded to resemble gussets 253 to the monopole 203. However, they do not protrude into the interior of the monopole structure. A cross sectional view of the receptor reveals the cavity within the steel pipe 251 comprising the receptor, a minimal layer of masonite or plastic washer 255 which extends approximately ½ inch from the entrance to the receptor, and a thin outer layer of simulated bark 257. As the steel female receptor 215 protrudes, it is also covered with artificial bark 235.

Referring to FIG. 11, to initially connect the female receptor 215 to the base of a bough 211, a thin layer adhesive such as polyurethane 263 or similar material is first placed within the receptor. The spine 265 emerging from the base of the bough is then placed within the steel pipe of the female receptor for a tight frictional and adhesive fit. There is also a nylon rope 266 through which the bolt or similar device passes for further support. Nevertheless, the preferred embodiments for connecting either branches or boughs to the female receptors require additional mechanical and adhesive means. In this manner, the chance for a branch or bough to break during adverse weather conditions is reduced.

Figure 12:
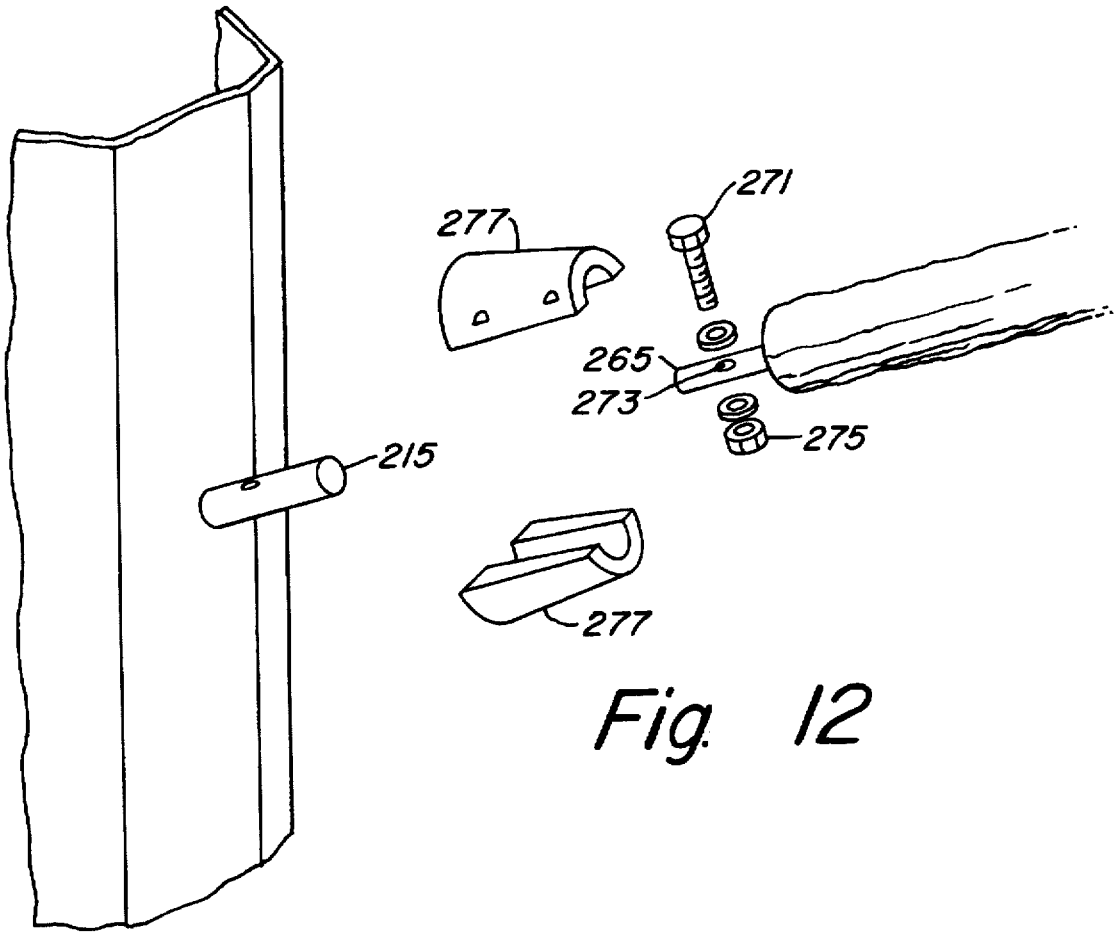
FIG. 12 illustrates the components of one possible mechanical attachment of a bough to the monopole.

Referring to FIG. 12, in one such approach, a bolt 271 or similar mechanical means is inserted through the upper surface of the receptor 215, through an opening 273 in the spine 265, and emerges at the lower surface of the receptor to be secured with a nut or similar means 275. Fittings 277 over the receptor and spine are also illustrated.

Figure 13:
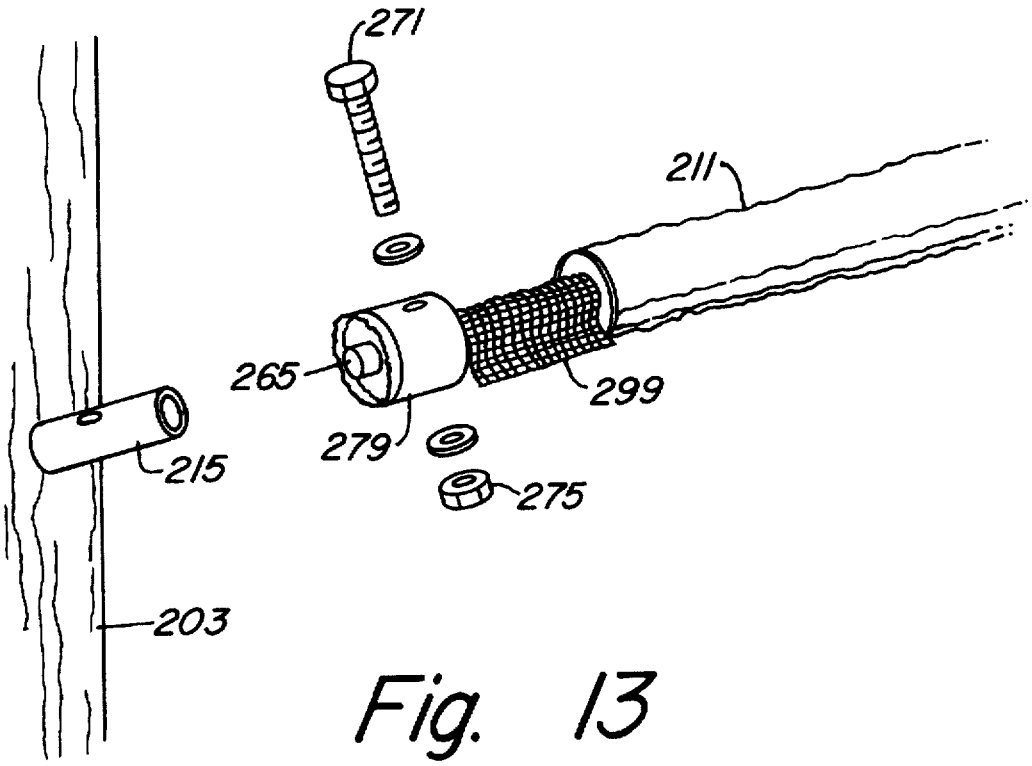
FIG. 13 illustrates a second mechanical attachment of a bough or branch to a monopole.

In FIG. 13, for another connector means, silicone sealant 279 is first applied to the perimeter of the base adjacent the monopole. The particular formula for this sealant used for the preferred embodiment is polydimethysiloxane 701310G7-8 and can be obtained from General Electric, Corp. in Waterford, New York. -However, similar sealants available from other sources can also be included within the scope of this invention. In this instance, the bolt enters an opening in the base, where it then pierces the female receptor, and emerges from the underside of the receptor tightly secured by a nut or similar means. Also included as a feature in this second variation is a nylon mesh 299. It is attached to the bough interior and contacts both the interior stem component and steel spine which protrudes from the base. In this fashion the nylon rope adds strength and further support by attachment to the trunk.

Figure 14:
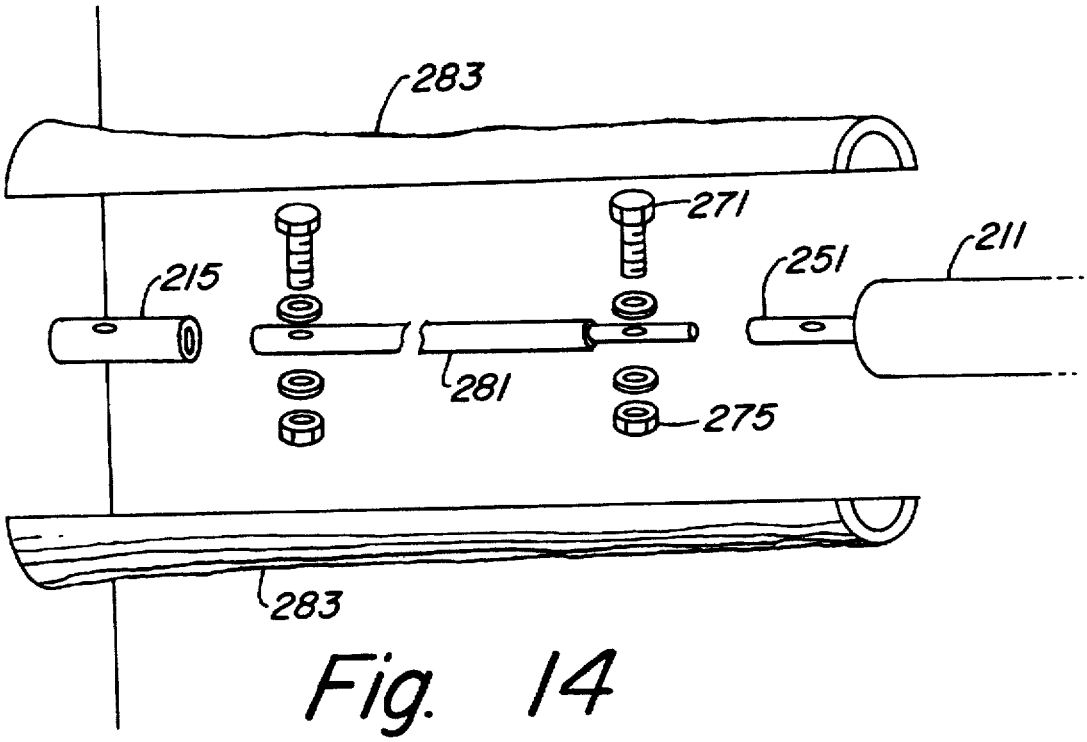
FIG. 14 illustrates a third approach, with additional components, for attachment of a bough or branch to a monopole.

In another variation for attachment to the female receptor, silicone, polyurethane sealant, or a similar material strengthens the ends of the bough segments 211 which surround the receptor and contact the trunk. In the interior of these two half-boughs is a cylindrical narrow bough extender 281 (FIG. 14) which simultaneously fits into the female receptor and spine at either of its terminals. This particular bough extender is reinforced mechanically with a plurality of bolts or similar mechanical devices. These devices pierce the receptor and the extender at several different locations along the length of the bough.

In this third variation, in the preferred embodiment the two half bough segments 283 which cover the bough extender 281 are injected with polyurethane. Necessarily, they cannot be glued together with additional urethane to encircle the extender, receptor, or mechanical fasteners until the tree components and monopole are assembled at a particular site. An additional feature for this fastener is a hook in the monopole's surface to which a fiberglass rope is attached simultaneously to the monopole and the bough for additional strength. Also, the end of the rope in the bough can be attached to the receptor. Please see FIG. 7.

FIG. 8 illustrates the monopole tower with all branches 211 and boughs 209 in place. In particular, it illustrates how each antenna panel assembly 205 attaches towards the top of the monopole 203. As can be seen receptors 215 are of different diameters to accommodate boughs 211 and branches 209 of different diameters. In the preferred embodiment the branches are sparse and the receptors do not completely encircle the trunk. In the dense embodiment, the branches and boughs fit into receptors which completely encircle the circumference of the trunk. Generally a dense tree will have eighty-four branches, while a sparse variation thereof will have only sixty.

Figure 15:
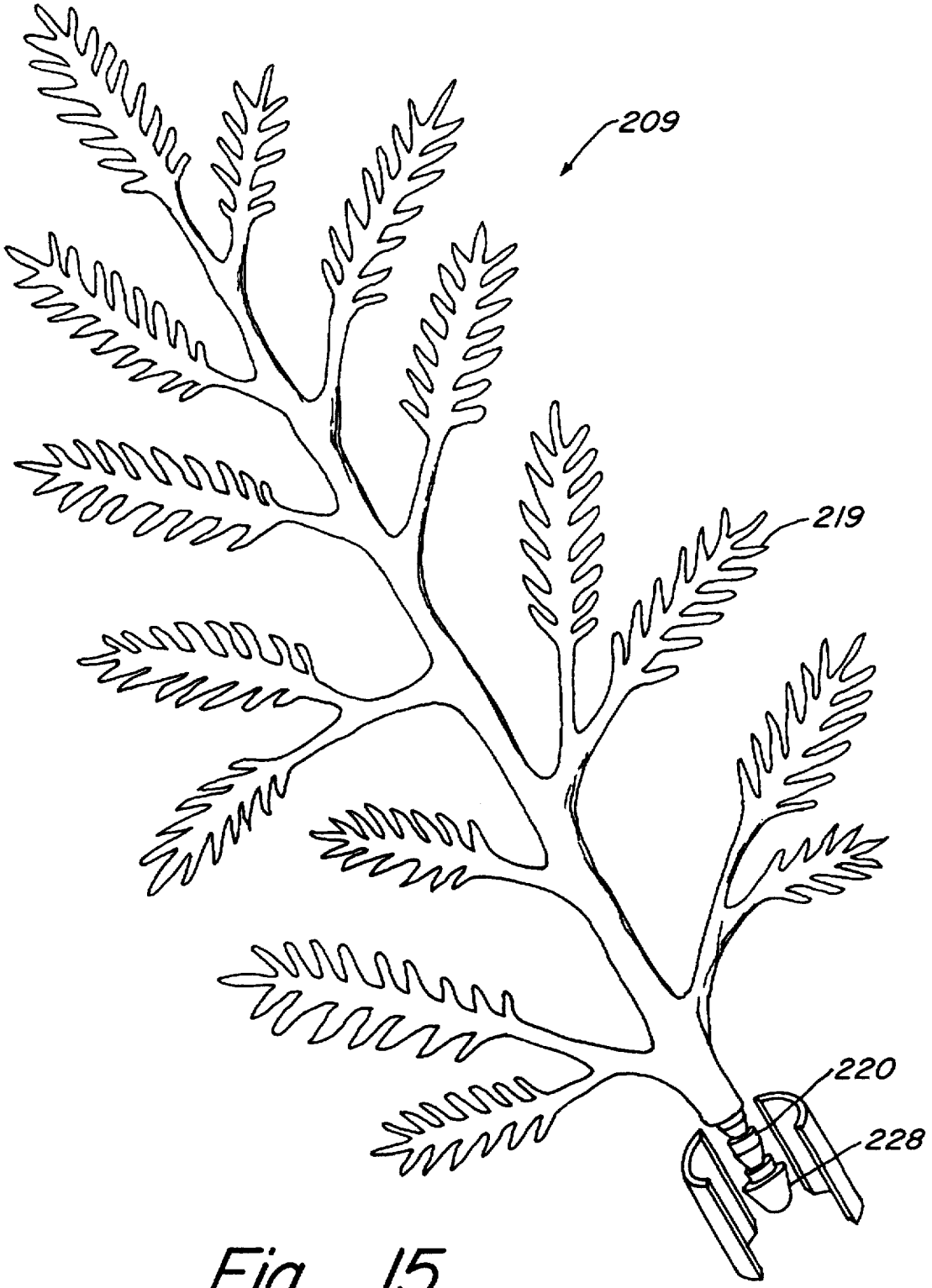
FIG. 15 illustrates a branch with simulated pine needle clusters and the branch's attachment to a female receptor or bough terminal.

FIG. 15 illustrates a branch 209 with pine needle clusters 219. Different sized branch stems will fit into differently sized bough openings 251 (FIG. 9)or female receptors 215. The pine needle clusters are made of the same urethane system as that of the bark on the trunk 237 and receptors 215. The liquid urethane component and catalyst are initially injected into silicon molds. The urethane prepolymer is mixed with the catalyst, containing polyether, polyol and an aromatic diamine. The length of the branches varies approximately 1 and ½ feet. 2 feet, 3 feet, and 4 feet.There are several pine needle cluster patterns available, and an infinite variety is contemplated within the scope of this invention.

As already noted, each stem of a branch 209 (FIG. 5) is molded to contain several notches 220 terminating in a rounded plug member 228. This portion of the stem is inserted between the two halves of a bough 211 with an adhesive means such as, but not limited to, polyurethane or fiberglass mixed with resin. The two half segments of the bough are then clamped together and additionally sealed with polyurethane,fiberglass resin, or other suitable material, leaving the last 3" to 4" knobbed stem portion of the branch inside the final three-dimensional cavity of the bough terminus. In this manner there are three sources of support for the branch: the mechanical support of stem notches, the frictionally fitting plug in the stem held by the bough, and the adhesive effect of the resin filling the remaining space in the half bough cavity between the two bough fastened together.

Figure 16:
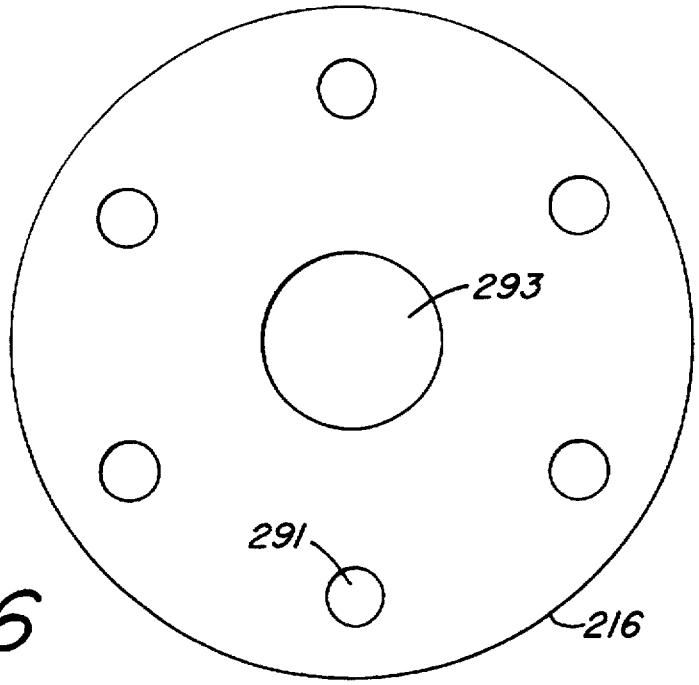
FIG. 16 illustrates a plan view of the baseplate of the monopole.

FIG. 16 is a plan view of the metal base of the monopole tower 216. It shows bolt opening 291 and cable access 293. Another embodiment within the scope of this invention includes a plurality of monopole towers fastened together, at a minimum, at their head or upper portions. In this manner, several monopoles, complete with a variety of wireless electronic communications antennae and related equipment, can be used to relay signals when one such monopole is insufficient. Such monopoles could be of the type described as the preferred embodiment for both artificial palm tree or pine trees described as the preferred embodiment in this application. The invention also includes within its scope other types of artificial foliage, mixed varieties of artificial foliage, and similar monopoles, which, however, are compatible with the systems described herein.

The preferred embodiment of this invention is intended to support and camouflage any type of wireless electronic communications antennae and equipment. This, of course would include users of cellular telephone apparatus in the area of the electromagnetic spectrum from 820 to 960 megahertz. However, the invention is capable of camouflaging and protecting any wireless electronic communication antennae and equipment during strong wind forces and snow.

This invention is similarly capable of protecting and camouflaging antennae which use the entire spectrum of radio frequencies, even if each antennae is designed for a specific or different use. In particular, there is no reason why the present invention cannot be adapted for AM,FM, police radio, taxicab radio, or pagers which use a variety of frequencies. In the preferred embodiment the range of frequencies is virtually unlimited.

This tower can also be used for frequencies somewhat lower or higher for the services which are mentioned above. Moreover, in this invention, all antennae panel are transceivers. Because the monopole is completely galvanized there can be no long-term penetration by corrosion. To this end each female receptor is welded to the monopole 3 (FIG. 1) or 203, FIGS. 8 and 13) as the case may be. This weld is then covered, first with galvanized primer paint, and secondly with polyurethane simulated bark material to produce an airtight, watertight protective surface.

In particular, the metal components as described herein, together with firmly secured artificial tree components, will not interfere with any region of the radiowave spectrum. In addition, there is also lightening protection provided for the monopoles because of an appropriate grounding system. In sum, with the present invention, a purchaser will be benefitted by an aesthetically pleasing functional utility structure which will remain camouflaged in adverse weather conditions without interference with necessary radio wavelengths.

What is claimed is:

1. A telecommunications tower, comprising in combination:

a steel tubular monopole which is tapered along its length to provide a greater cross-sectional dimension at its base than at its top, the monopole being polygonal with equally spaced flat sides;

at least one antenna mounted to the monopole near its top;

a layer of artificial bark covering the monopole to simulate a tree trunk;

a plurality of tubular receptors, each having a base end welded to the monopole at selected points along the length of the monopole, each receptor protruding laterally through the bark from the monopole and having an open outer end;

a plurality of artificial tree branches, each having a stem portion with artificial tree leaves extending therefrom, the stem portion of each of the tree branches having a base end which slidingly mates with one of the receptors;

securing means for securing each of the base ends to one of the receptors; and a plurality of flexible safety lines, each embedded within the stem portion of each of the tree branches and having a free portion protruding from the base end of each of the stem portions into one of the receptors where it is secured to retain the tree branch with the monopole in the event of a failure of the securing means.

2. The tower according to claim 1, wherein:

the base end of each of the stem portions comprises a tubular spine which joins and protrudes inward from a larger diameter section of the stem portion, defining an inward racing shoulder; and wherein the tower further comprises:

a precast layer of artificial tree bark which is secured around each of the receptors and abuts the shoulder of each of the stem portions.

3. The tower according to claim 1, wherein:

the base end of each of the stem portions comprises a tubular spine which joins and protrudes inward from a larger diameter section of the stem portion, defining an inward facing shoulder; and wherein the tower further comprises:

a layer of artificial tree bark which is precast into semi-cylindrical segments which are secured around each of the receptors in abutment with the shoulder of each of the stem portions.

4. The tower according to claim 1, wherein:

the base end of each of the stem portions comprises a tubular spine which joins and protrudes inward from a larger diameter section of the stem portion, defining an inward facing shoulder;

the securing means comprises a fastener which extends transversely through each of the receptors and the spines; and wherein the tower further comprises:

a layer of artificial tree bark which is precast into semi-cylindrical segments which are secured around each of the receptors, completely enclosing the fastener and in abutment with the shoulder of each of the stem portions.

5. The tower according to claim 1 wherein the bark and the branches simulate those or a palm tree.

6. The tower according to claim 1 wherein the bark and the branches simulate those of a pine tree.

7. A telecommunications tower, comprising in combination:

a steel tubular monopole which is tapered along its length to provide a greater cross-sectional dimension at its base than at its top, the monopole being polygonal with equally spaced flat sides;

a plurality of antennas mounted to the monopole near its top;

a layer of artificial bark covering the monopole to simulate a tree trunk;

a plurality of tubular receptors, each having a base end welded to the monopole at selected points along the length of the monopole, each receptor protruding laterally through the bark from the monopole and having a bore with an open outer end;

a plurality of artificial tree branches, each having a stem portion with artificial tree leaves extending therefrom, the stem portion of each of the tree branches having an inner and;

a plurality of spines, each protruding from the inner end of one of the stem portions, each of the spines having a diameter smaller than the stem portion at the inner end, defining a shoulder facing toward one of the receptors and spaced outward from the base end of the receptor, each of the spines being inserted into the bore of one of the receptors;

a fastener extending transversely through each of the receptors and the spines for securing each of the spines to one of the receptors; and a precast layer of bark which is secured around each of the receptors and the spines between the layer of bark on the monopole and the shoulder of each of the stem portions.

8. The tower according to claim 7, wherein each of the precast layers of bark completely encloses one of the fasteners.

9. The tower according to claim 7, wherein each of the precast layers of bark comprises a plurality or semicylindrical segments which are secured around one of the receptors over the fastener.

10. The tower according to claim 7, wherein at least some of the spines further comprise:

an extender portion which is releasably joined to the spine to lengthen the amount of protrusion of the spine from the stem portion.

11. The tower according to claim 7, wherein each of the stem portions has at least one tubular socket protruding therefrom; and wherein the artificial tree leaves each has a mandrel which inserts into and is secured to one of the sockets.

12. The tower according to claim 7, further comprising.:

a plurality of safety lines, each embedded within one of the stem portions and having a free end extending outward from the spine and into one of the receptors where it is secured.

13. The tower according to claim 7 wherein the bark and the branches simulate those of a palm tree.

14. The tower according to claim 7 wherein the bark and the branches simulate those of a pine tree.

15. The tower according to claim 7 further comprising:

a tapered top section secured to the top of the monopole and extending upward therefrom, the top section having an exterior which simulates the trunk of a tree; wherein at least some of the receptors and tree branches are mounted to the top section; and all of the antennas are mounted to the monopole below the top section.

16. A telecommunications tower, comprising in combination:

a steel tubular monopole which is tapered along its length to provide a greater cross-sectional dimension at its base than at its top, the monopole being polygonal with equally spaced flat sides;

a layer of artificial bark covering the monopole to simulate a tree trunk;

a separate tapered top section secured to the top of the monopole and extending upward therefrom, the top section having an exterior which simulates the trunk of a tree;

a plurality of antennas mounted to the monopole near its top, all of the antennas being mounted below the top section;

a plurality of tubular receptors, each having a base end mounted to the monopole and the top section at selected points along the lengths of the monopole and the top section, each receptor protruding laterally;

a plurality of artificial tree branches, each having a stem portion with artificial tree leaves extending therefrom, the stem portion of each of the tree branches having a base end which is inserted into one of the receptors; and securing means for securing each of the stem portions to one of the receptors.

17. The tower according to claim 16 wherein the top section is constructed of a nonmetallic material.

* * * * *